United States Patent [19]

Merrell

[11] Patent Number: 4,458,606

[45] Date of Patent: Jul. 10, 1984

[54] METHOD OF CONDITIONING FIRESIDE FOULING DEPOSITS USING LARGE PARTICLE SIZE AMORPHOUS SILICA

[75] Inventor: Gene A. Merrell, Huntingdon Valley, Pa.

[73] Assignee: Betz Laboratories, Inc., Trevose, Pa.

[21] Appl. No.: 364,378

[22] Filed: Apr. 1, 1982

[51] Int. Cl.[3] ..... F23B 7/00

[52] U.S. Cl. ..... 110/343; 44/4; 110/347

[58] Field of Search ..... 110/342, 343, 344, 345, 110/347; 44/1 SR, 4, 5

[56] References Cited

U.S. PATENT DOCUMENTS

| | | | |
|---|---|---|---|
| 3,249,075 | 5/1966 | Nelson et al. | 110/343 |
| 4,253,408 | 3/1981 | Kramer | 110/343 |
| 4,329,324 | 5/1982 | Jones | 110/345 |
| 4,369,719 | 1/1983 | Engstrom et al. | 110/343 |
| 4,372,227 | 2/1983 | Mahoney et al. | 110/343 |

FOREIGN PATENT DOCUMENTS

| | | | |
|---|---|---|---|
| 1551700 | 4/1970 | Fed. Rep. of Germany | 110/343 |

*Primary Examiner*—Edward G. Favors
*Assistant Examiner*—Steven E. Warner
*Attorney, Agent, or Firm*—Alexander D. Ricci; Bruce E. Peacock

[57] ABSTRACT

In a coal fired boiler of the type having a combustion zone in which said coal is fired, a convection zone located downstream from said combustion zone and having a plurality of heater tubes disposed therein adapted to heat water or steam disposed therein, and in which convection zone combustion residues emanating from said coal have a tendency to stick to or agglomerate upon said tubes, a method of decreasing said tendency to stick or agglomerate, comprising burning said coal in the presence of an additive consisting essentially of amorphous silica particles, substantially all of said particles being greater than about 38 microns in diameter.

6 Claims, No Drawings

METHOD OF CONDITIONING FIRESIDE FOULING DEPOSITS USING LARGE PARTICLE SIZE AMORPHOUS SILICA

FIELD OF THE INVENTION

The present invention pertains to a method of reducing the adverse effects of solid fuel combustion residues on the structures with which these residues normally contact. The invention is particularly, although not exclusively, advantageous in connection with use in coal-fired boiler units so as to increase the friability of combustion residues which may normally adhere to boiler surfaces and to minimize slagging problems normally attendant upon combustion of the fuel.

BACKGROUND OF THE INVENTION

When solid fuels are burned in boiler furnaces and the like, the residues emanating from the fuel collect on the internal surfaces of the boiler to impede heat transfer functions, and result in increased boiler downtime for cleaning and repair. For instance, undesirable slag deposits, may be formed in the high temperature firebox area, requiring boiler shutdown for complete removal thereof.

Ash-like residues often tenaciously stick to fireside boiler tubes, economizers, and preheaters. These ash deposits accumulate and block passages through which the hot boiler gases are designed to pass.

Ash deposits are periodically cleaned via soot blower devices or the like. However, to the extent that the ash agglomeration is more tenacious than the cleaning draft or force exerted by the soot blowers, severe problems are encountered. This problem has become magnified in recent years as the ash level of utilized fuels has increased due to such factors as the low availability and excessive cost of high quality fuels. These factors result in ever increasing economic pressures to burn lower cost, lower quality fuels.

PRIOR ART

Many and varied approaches, attempting to minimize boiler fuel-related fouling and deposition problems, have been suggested. For instance, in U.S. Pat. No. 3,249,075 (Nelson et al) entitled "Additive Mixtures to Combat High Temperature Corrosion and Ash Bonding During The Operation of Furnaces" it is suggested to add silica and compounds of silica with at least one oxide selected from the group consisting of sodium oxide, potassium oxide, calcium oxide, magnesium oxide, titanium dioxide and aluminum oxide, to the fuel combustion products. Exemplified compounds include hydrated aluminum silicates, diatomaceous earths, calcium silicates, hydrated calcium silicates, magnesium silicates, hydrated magnesium silicates, aluminum silicates, colloidal silica, infusonal earths, synthetic diatomites, asbestos, mica, perlite, talc, Attapulgus clay, silicic acid and silica gel.

Of similar import are U.S. Pat. Nos. 3,817,722 (Scott) and 2,059,388 (Nelms). The Scott patent discloses the use of an $SiO_2MgO$ mixture to inhibit corrosion and ash deposition in fossil fuel burning equipment. The Nelms patent is specifically directed toward an additive for improvement in the burning of bituminous coal comprising treating the coal with water, sodium silicate and salt.

To minimize formation of sulfuric acid deposits in the lower temperature zones of the boiler (the "cold end"), U.S. Pat. No. 4,245,573 (Dixit et al) suggests utilization of a magnesium oxidemagnesium silicate mixture wherein the mixture is injected into the boiler flue gas stream portion having a temperature of about 1700°-2300° F.

U.S. Pat. No. 2,692,863 (Iler) entitled "Process of Preparing A Silica Organosol and Resulting Product" discloses a silica sol material comprising a colloidal suspension of amorphous silica particles. The disclosure points out that diesel and rocket fuel may be benefitted by. use of the disclosed sols as the silica particles thereof provide a catalytic surface for combustion and keep the chamber clean. The disclosed silica particles range from about 10-150 millimicrons in diameter.

DETAILED DESCRIPTION OF THE INVENTION

Despite the above-noted prior art efforts, there remains a need in the art for a fuel additive, adapted specifically for utilization in conjunction with solid fuels, which additive minimizes slagging tendencies and provides for more "friable" ash combustion residues. Such "friable" particles, when they adhere to internal boiler structure, may be more readily eliminated from these structures by soot blowers and the like.

As used herein, the term "fireside" refers to heat transfer surfaces in those boiler sections that are in contact with the hot combustion gases. These "fireside" sections conventionally include the economizer, convection zone, superheater, and furnace sections of the boiler.

The present application is therefore directed toward a boiler fuel additive which is adapted to minimize slagging tendencies and to provide a more "friable" ash deposit in the fireside sections of the boiler.

Specifically, the fuel additive of the present invention comprises large particle size amorphous silica particles wherein substantially all of the particles are greater than about 38 microns in diameter. In a preferred embodiment at most about 10% (volume) of the particles are greater than about 170 microns in diameter and at least about 90% (volume) of the particles are greater than about 38 microns. The median (volume) particle size of the preferred silica is about 95 microns. These physical properties have not been recognized in the art as being result-effective variables with respect to the function of providing a softer more friable ash that is more readily cleaned from "fireside" boiler structures by means of soot blowers and similar devices.

Effective amorphous silica powder particles, in accordance with the invention, have a particle size distribution closely approximating the following:

SIZE DISTRIBUTION TABLE

| Particle Size (microns) | Volume Percent Greater Than |
|---|---|
| 10 | 99 |
| 26 | 95 |
| 38 | 90 |
| 48 | 85 |
| 57 | 80 |
| 64 | 75 |
| 70 | 70 |
| 76 | 65 |
| 82 | 60 |
| 88 | 55 |
| 95 | 50 |
| 101 | 45 |
| 107 | 40 |
| 113 | 35 |

-continued

SIZE DISTRIBUTION TABLE

| Particle Size (microns) | Volume Percent Greater Than |
|---|---|
| 120 | 30 |
| 127 | 25 |
| 130 | 20 |
| 153 | 15 |
| 170 | 10 |
| 191 | 5 |
| 250 | Trace |

One such effective amorphous silica powder that is commercially available is Degussa's sipernat 22 amorphous silica. This particular silica is a white powder produced by a process which comprises treating an alkaline silicate solution with acid to produce the desired amorphous silica precipitate. The precipitate is then filtered and washed. During the precipitation process "primary. particles" with a size of about 20 nanometres are initially formed. These particles combine to form large agglomerates and aggregates, the particle sizes of which substantially correspond to the above-listed desired particle size distribution. Substantially all of the sipernat 22 amorphous silica particles are greater than about 38 microns in diameter. Specifically, it is to be understood that use of the phrase "substantially all" is meant to describe the above noted particle size distribution table wherein about 90% of the particles (by volume) are greater than about 38 microns.

One such precipitation process, thought suitable for producing effective amorphous silica in accordance with the invention, is disclosed in U.S. Pat. No. 4,003,981 (Turk et al). The entire disclosure of this patent is incorporated by reference. It is noted that the shearing step and grinding steps discussed in this patent would not be utilized so that large secondary amorphous silica particles, on the order of the table above noted, may be retained.

The large size amorphous silica particles of the invention may be admitted into any type of furnace firing solid fuels, such as coal, wood, peat, sewage and municipal waste burning furnaces. Ideally, these additives are used in conjunction with coal-fired boilers. All types of boilers including cyclone, pulverized coal, and stoker fed boilers may be beneficially treated with the $SiO_2$ additive of the present invention.

In coal fired boilers of the type having a combustion zone in which the coal is fired, and a convection zone disposed downstream from the combustion zone in which convection zone heater tubes are positioned to heat water to form steam or to heat steam to form superheated steam, the tendency is for sticky, tenacious ash deposits to form on or around these heater tubes. To minimize the deleterious effects of these deposits, the coal is fired in the presence of the fuel additive either by adding the additive directly to the coal or by injecting the additive upstream from the convection zone so that the turbulent gas forces will carry the additive to the desired working area.

The additives may either be shot fed or continuously fed. In cyclone boilers it is advantageous to admit the large sized $SiO_2$ particles into the upper furnace area, just upstream from the convection tubes. The additive will be distributed through the boiler by the turbulent flow of the combustion gases. For stoker and pulverized coal burning units, the additive may be fed directly with the coal in lieu of or in addition to possible feeding upstream from the boiler convection section.

The amount of additive to be used will depend upon many factors, such as the flue gas temperature at the collecting surface, the design of the boiler, the burner configuration, and, of course, the impurity content of the fuel. The higher the flue gas temperature, the greater is the tendency toward the formation of deposits. With narrowly spaced superheater tubes, the tendency to clog the passage between the tubes is greater. The greater the impurity content of the fuel, the greater is the tendency toward the production of deleterious combustion residues. The amount of additive to be combined with the solid fuel will, of course, be greater as any of these disadvantageous situations increases in intensity.

Operable additive dosage rates encompass use of between trace amounts–2.00% (wt %; weight additive: weight ash). The lower levels will be operable in shot-feeding applications. Preferably, the $SiO_2$ particles of the present invention are added within a range of about 0.5%–1.0%.

EXAMPLES

The invention will be further illustrated by the following examples which are included as being illustrative of the invention but which should not be construed as limiting the scope thereof.

In ascertaining the effective particle size distribution of the amorphous silica particles of the present invention, a sample of sipernat 22 amorphous silica particles was subjected to particle size distribution analysis utilizing a HIAC PA-720 Particle Size Analyzer. This device operates on a light blockage principle. Particles suspended in solution are passed through a detector cell at a constant flow rate. Once in the detector, the particles interrupt the light intensity between a light source and a photometer. The photometer output is an electric current proportional to the incident beam. These electric pulses vary in height, with each height being characteristic of a predetermined particle size. The particle size distribution resulting from this analysis is reflected hereinabove in the "Size Distribution Table."

Sintering Test and Fly Ash Analysis

In order to gauge the efficacy of the amorphous silica particles of the present invention in increasing the friability of coal ash deposits, these particles, in addition to other furnace additives, were subjected to a sintering test. This test (proposed by Barnhart and Williams, see Trans. of the ASME, 78, p 1229–36; August 1956) is intended to determine the tendency of a particular ash to form hard, bonded deposits in the convection sections of coal-fired boilers. The test involves drying fly ash to constant weight, compressing it into a cylindrical shape, heating it to the desired temperature for a designated time period, slowly cooling the cylinder, and measuring the pressure needed to burst the sintered pellet.

Higher compressive strengths needed to burst similar pellets are indicative of more severe fouling problems when compared to similar pellets which are burst via lower compressive strengths. In this manner, the relative efficacies of different fuel additives in minimizing the deleterious effects of combustion ashes may be determined by comparing pellet sintering strengths for each additive.

The fly ash which is pelletized should be representative of the particular ash passing through the boiler. In this respect, fly ash was collected from the electrostatic precipitators of two western subbituminous coal fired boilers.

In forming the pellets of compressed fly ash, the loose ash material was placed in a die that was fabricated from high carbon steel. The die was hardened by heat treatment in order to minimize the effects of abrasion by the ash particles. In order to form a pellet that was fairly easily transported from the die to a muffle furnace, the ash was normally pressed into pellet form at 1600 psi for 30 seconds. Prior to pelletizing, the ash was ignited to constant weight at 900° F. to remove unburned carbon.

The pellets were placed in the center of a furnace at room temperature and allowed to reach the predetermined sintering temperature over a period of about 1.25 hours. After 16 hours, the power to the furnace was shut down and the door was opened about 0.25 inch. When the furnace temperature was reduced to below 500° F., the door was opened fully. Cooling to 500° F. normally required 3 hours. If the pellets were cooled at a faster rate, they would be stressed and their compressive strengths greatly reduced.

The majority of the sintering tests reported hereinbelow were conducted with the additive material mixed intimately with the ash. This approach approximates that of a continuous additive feed condition.

Analysis of the fly ash samples taken from the two western boilers revealed the following:

| | Fly Ash Analysis | |
|---|---|---|
| | Western #1 Fly Ash | Western #2 Fly Ash |
| Location | % | % |
| $SiO_2$ | 46 | 37 |
| $Al_2O_3$ | 9 | 8 |
| $TiO_2$ | 1 | 2 |
| $Fe_2O_3$ | 9 | 9 |
| CaO | 13 | 9 |
| MgO | 8 | 14 |
| $K_2O$ | 1 | |
| $Na_2O$ | 4 | 8 |
| BaO | 1 | 2 |
| CuO | 2 | 2 |
| ZnO | 1 | |
| $P_2O_5$ | 1 | |
| $SO_3$ | 2 | 11 |
| LOI | 2 | |

The results of initial sintering tests run on Western #1 fly ash are reported in Table I below. In all instances in this test, the additives were intimately mixed with the ash in an amount of 1% (by weight additive to weight ash). The % reduction is sintering strength resulting from utilization of the tested additives was calculated by recording the compressive strength needed to burst untreated pellets, and comparing that value to the compressive strength needed to burst treated pellets sintered at the same temperature.

TABLE I

| Sintering Strength Modification of Western #1 Fly Ash | | | | |
|---|---|---|---|---|
| | % Reduction in Sintering Strength | | | |
| Material | 1500° F. | 1600° F. | 1700° F. | 1800° F. |
| $Al_2O_3.SiO_2$ | 16 | 23 | 33 | 8 |
| Ajax P | | | −3 | 1 |
| Hydrite UF | | | 2 | −10 |
| Kaophile 2 | | | 6 | 5 |
| Sipernat 22 | 27 | 13 | 25 | 20 |
| RS-1 | −35 | 0 | 3 | 16 |
| $TiO_2$ | 4 | 0 | 2 | 0 |
| $Al_2O_3$ | 1 | 8 | −8 | 0 |
| $ZrO_2$ | 8 | 8 | 0 | 4 |
| $Cu_2O$ | 5 | −1 | 4 | 6 |
| ZnO | 1 | 5 | 14 | 21 |
| $CeO_2$ | 52 | 46 | 58 | 9 |
| $SnO_2$ | 100 | 84 | 100 | 15 |
| CoO | 54 | 78 | 73 | 2 |
| $Si_3N_4$ | 48 | 71 | 7 | |

Ajax P = $Al_2O_3.SiO_2$, Georgia Kaolin Co.
Hydrite UF = $Al_2O_3.SiO_2$, Georgia Kaolin Co.
Kaophile 2 = $Al_2O_3.SiO_2$, Georgia Kaolin Co.
Sipernat 22 = $SiO_2$, Degussa.
RS-1 = $SiO_2$, Reynolds With respect to Table I above, it is noted that several materials appear efficacious in decreasing the strength of the tested location #1 pellets. Specifically, $Al_2O_3.SiO_2$, Sipernat 22, $CeO_2$, $SnO_2$, CoO, and $Si_3N_4$ appeared effective. However, raw material costs limit the use of $CeO_2$, $SnO_2$, CoO, and $Si_3N_4$ within a commercial context.

In Table II following, $Al_2O_3.SiO_2$ was not found to significantly lower the sintering strengths of the ash pellets formed from Western #2 fly ash. Accordingly, it is judged, from the data, that the most efficacious and economic ash conditioning agent is SIPERNAT 22 amorphus silica.

TABLE II

| Sintering Strength Modification of Western #2 Fly Ash | | | | | | | |
|---|---|---|---|---|---|---|---|
| | % Reduction in Sintering Strength | | | | | | |
| Material | 1200° F. | 1300° F. | 1400° F. | 1500° F. | 1600° F. | 1700° F. | 1800° F. |
| 5% $Al_2O_3.SiO_2$ | −12 | −4 | −35 | −20 | | | −58 |
| Sipernat 22 | 25 | 28 | 28 | 41 | 47 | 58 | 53 |
| BaO | | | | | | | −8 |
| C-30 | | | | −5 | 23 | 16 | |
| C-31 | | | | −14 | 9 | 14 | |
| $CeO_2$ | | | | −28 | 3 | | |
| $Fe_2O_3$ | | | | −35 | −8 | | |
| $ZrO_2$ | | | | −38 | | 6 | |
| NiO | | | | −42 | | | |
| CaO | | | | −36 | | | |
| MgO | | | | 21 | | | |
| $Al_2O_3$ | | | | −10 | | | |
| RS-1 | −46 | −34 | −16 | | | | |

(Unless indicated otherwise all treatment levels are 1% wt additive/wt. pellet ash)
C-30 = $Al(OH)_3$ - Alcoa
c-31 = $Al(0H)_3$ (coarse) - Alcoa As is evident from Tables I and II, SIPERNAT 22 amorphous silica produced significant sintering strength reductions on both Western #1 and Western #2 pellets. As noted above, this particular material is an amorphous silica powder having a relatively large particle size.

As a means of further demonstrating the enhanced effect of the SIPERNAT 22 amorphous silica in sintering strength reduction, the performance of this particular silica is contrasted to other commercially available silicas with Western #2 location fly ash. As may be seen by Table III, the SIPERNAT 22 amorphous silica performs far better than the other commercially available silicas in this respect and is almost equally as efficacious over the entire range of sintering temperatures encountered.

TABLE III

| Sintering Strength Modification of Location #2 Fly Ash with $SiO_2$ Materials | | | | | | |
|---|---|---|---|---|---|---|
| | % Reduction in Sintering Strength | | | | | |
| Material | 1300° F. | 1400° F. | 1500° F. | 1600° F. | 1700° F. | 1800° F. |
| 1% Sipernat 22 | 28 | 28 | 41 | 47 | 58 | 53 |
| 0.5% Sipernat 22 | | 26 | 10 | 26 | 22 | 17 |
| 1% RS-1 | −34 | −16 | | | | |
| 1% Sipernat 22S | | | | | 12 | 2 |
| 1% Sipernat D17 | | | | | | −23 |
| 1% Silanox 101 | | | | | | 10 |
| 1% HiSil 233 | | | | | 6 | |

RS-1 = $SiO_2$ - Reynolds
Sipernat 22S = $SiO_2$ - Degussa
Sipernat D17 = $SiO_2$ - Degussa
Silanox 101 = $SiO_2$ - Cabot Corp.
HiSil 233 = $SiO_2$ - PPG Industries Table IV herein lists various physical properties of the different amorphous silica powders tested. It is noted that the secondary particle size of the SIPERNAT 22 amorphous silica powders is considerably larger than the other available silicas. The other listed physical properties do not vary greatly from silica to silica. Accordingly, the only physical property that can be correlated to sintering strength reduction is that of particle size.

TABLE IV

| Physical Properties of Commercial Silicas | | | | | | |
|---|---|---|---|---|---|---|
| | Sipernat 22 | Sipernat 22S | Sipernat D17 | RS-1 | HiSil 233 | Silanox 101 |
| BET surface area ($m^2/g$) | 190 | 190 | 100 | 21 | 150 | 305 |
| Average primary particle size (nm) | 18 | 18 | 28 | | 21 | 7 |
| Average secondary particle size (um) | 80–100 | 5 | 3 | 0.4 | 17 | |
| % $SiO_2$ | 98 | 98 | 99.5 | 98.2 | 88 | 95 |

Effect of Additive Particle Size on Sintering Strength

To ascertain if additive materials having particle sizes roughly corresponding to the SIPERNAT 22 amorphous silica particle sizes would prove efficacious in reducing the fly as pellet sintering strengths, three other materials, having particle sizes roughly equivalent to the SIPERNAT 22 amorphous silica sizes, were tested as additives. One such additive, Alcoa C-30 is hydrated alumina, $Al(OH)_3$, containing particles within the 50–200 micron range. Two types of fly ash were also used as additives. These particular fly ash samples contained particles ranging up to about 250 microns.

These test additives were sieved with certain sieved portions being segregated and tested separately for sintering strength reduction. Table V presents the sintering strength reductions obtained with these additives at 1700° F. Variations in sintering strength reductions with additive particle size are observed for each material. The magnitude and direction of change in the reductions depend on the material used, however. SIPERNAT 22 amorphous silica surprisingly produces the largest reductions; the sintering strength decreases as the particle size is increased to about 75 microns and then the sintering strength levels off.

TABLE V

| Sintering Strength Reduction Western #2 Fly Ash Pellets | | | | | | |
|---|---|---|---|---|---|---|
| | Particle Size Range (microns) | | | | | |
| Additive | >250 | 150–250 | 106–150 | 75–106 | 45–75 | <45 |
| Sipernat 22 | 62% | 60% | 62% | 64% | 51% | 33% |
| C-30 | | −5% | −2% | −11% | 3% | |
| Fly Ash Sample 1 | | 3% | 9% | 14% | 20% | 7% |
| Fly Ash Sample 2 | | 17% | 13% | −10% | 10% | |

It is accordingly apparent that amorphous silica having a particle size distribution corresponding to the SIPERNAT 22 amorphous silica distribution is efficacious in increasing the friability of ash deposits which form on boiler surfaces. Use of such an additive will therefore result in enhanced boiler heat transfer operation, as the soot blowers, operatively disposed in the boiler, will be better able to remove ash deposits which have agglomerated on furnace walls, superheater tubes, etc. Use of the large sized amorphous silica particles of the present invention will also decrease the tendency of the combustion residue products in forming slag on firebox and other high temperature structures.

Although the efficacy of the present invention has been demonstrated by the use of one particular commercially available amorphous silica powder, the skilled artisan will appreciate that any such amorphous silica powders will prove effective, provided that the particles thereof substantially approximate the particle size distribution above listed in the Description of The Invention.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

I claim:

1. Method of minimizing the deleterious effects of combustion residues emanating from coal burned as fuel in a boiler of the type having a furnace combustion zone in which said coal is burned and a convection zone located downstream from said combustion zone, said method comprising adding amorphous silica particles to said boiler in an amount of between about trace–2.0% by weight of said particles (based upon the weight of said residues) at a location upstream from said convection zone, wherein at most about 10% of said particles, by volume, are greater than about 170 microns in diameter and wherein at least about 90%, by volume, of said particles are greater than about 38 microns in diameter.

2. Method as defined in claim 1 comprising adding between about 0.5%–1.0% by weight of said particles (based upon the weight of said residues).

3. Method of minimizing the deleterious effects of combustion residues emanating from coal burned as fuel in a boiler of the type having a furnace combustion zone in which said coal is burned, said method comprising adding amorphous silica particles directly to said coal in said combustion zone in an amount of between trace–2.0% by weight of said particles (based upon the weight of said residues), wherein at most about 10% of said particles, by volume, are greater than about 170 microns in diameter and wherein at least about 90%, by volume, of said particles are greater than about 38 microns in diameter.

4. Method as defined in claim 2 comprising adding between about 0.5%–1.0% by weight of said particles (based upon the weight of said residues).

5. In a coal fired boiler of the type having a combustion zone in which said coal is fired, a convection zone located downstream from said combustion zone and having a plurality of heater tubes disposed in said convection zone and adapted to heat water or steam disposed therein, and in which convection zone combustion residues emanating from said coal have a tendency to stick to or agglomerate upon said tubes, a method of decreasing said tendency to stick or agglomerate, comprising burning said coal in the presence of an additive consisting essentially of amorphous silica particles, wherein at most about 10% of said particles, by volume, are greater than about 170 microns in diameter and wherein at least about 90%, by volume, of said particles are greater than about 38 microns in diameter, and wherein said particles are added to said boiler in an amount of between about trace–2.0% by weight of said particles based upon the weight of said combustion residues.

6. Method as defined in claim 5 comprising adding between about 0.5%–1.0% by weight of said particles based upon the weight of said combustion residues.

* * * * *